United States Patent [19]

DeCosa et al.

[11] 4,360,947

[45] Nov. 30, 1982

[54] DUST COLLECTOR

[76] Inventors: Charles DeCosa, c/o George Spector, 3615 Woolworth Bldg., 233 Broadway; George Spector, 3615 Woolworth Bldg., 233 Broadway, both of New York, N.Y. 10007

[21] Appl. No.: 202,370

[22] Filed: Oct. 30, 1980

[51] Int. Cl.[3] ..... A47L 9/10

[52] U.S. Cl. ..... 15/323; 15/339; 15/352; 15/415 R; 55/359; 55/428

[58] Field of Search ..... 15/310, 311, 339, 347, 15/352, 353, 415 R, 323; 55/359, 428

[56] References Cited

U.S. PATENT DOCUMENTS

| | | | |
|---|---|---|---|
| 1,161,087 | 11/1915 | Tyler | 15/339 |
| 1,817,337 | 8/1931 | Baker | 15/409 X |
| 2,013,498 | 9/1935 | McConaughy | 15/310 X |
| 2,529,965 | 11/1950 | Rentz | 15/327 F X |
| 3,177,635 | 4/1965 | Cawl et al. | 15/339 X |

*Primary Examiner*—Chris K. Moore

[57] ABSTRACT

A bucket into which ashes and dust from a wood stove or fireplace is shoveled by a vacuum cleaner so as to prevent it blowing into the atmosphere, the bucket including a removable cover having a connection to a vacuum cleaner hose, for transferring the dust and ash from the bucket to the vacuum cleaner, and the invention, in one design thereof including a shovel connected by another hose to the bucket so that shoveled dust and ash is pulled directly therefrom into the bucket.

2 Claims, 7 Drawing Figures

DUST COLLECTOR

This invention relates generally to vacuum cleaning equipment.

It is well known that a conventional cleaning of a wood stove or fireplace usually results in a large amount of ash and dust blowing into the air, so that it is unhealthy to breathe, or the dust thereafter falls on other objects in the room, contaminating clean articles exposed thereto. This is objectionable and is therefore in want of an improvement.

Accordingly, it is a principal object of the present invention to provide a dust collector which permits scooping ashes out of a wood stove or fireplace in a manner whereby the scooped ash is not carried exposed to the atmosphere as it is transmitted to a collection bucket.

Figure 1:
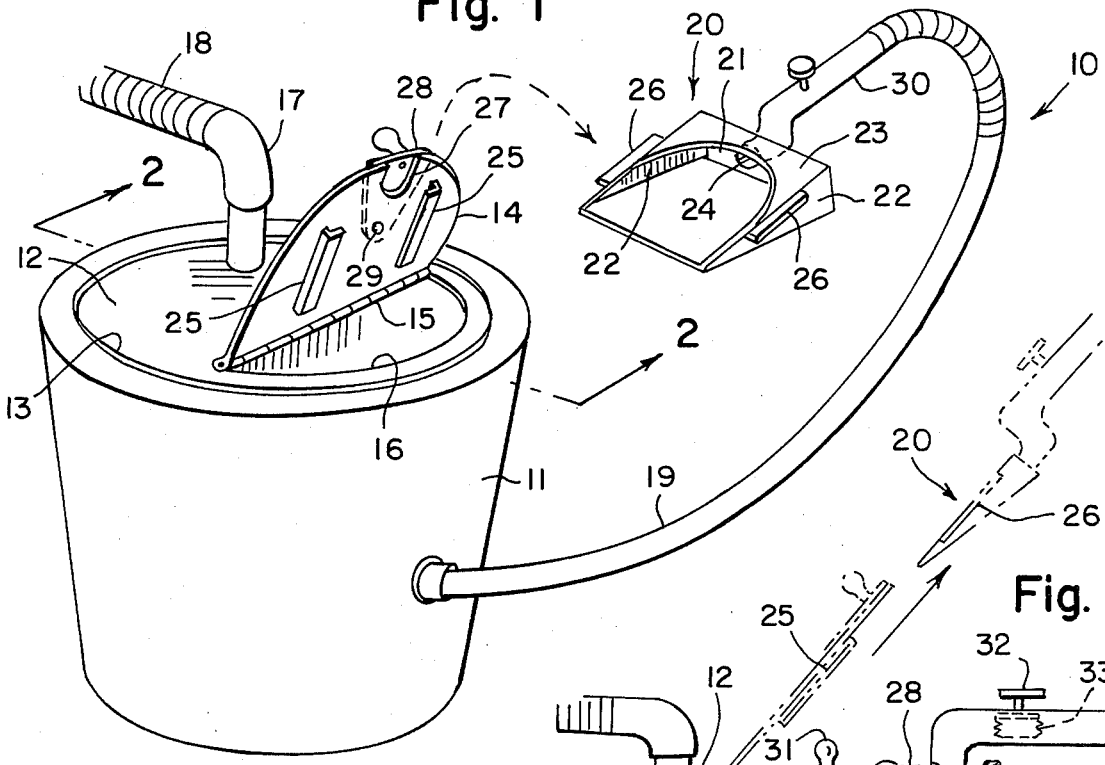
FIG. 1 is a perspective view of one design of the invention, which includes its own shovel connected by a vacuum hose to the bucket, so if preferred, the ashes can be vacuumed directly from the shovel instead of throwing it into the bucket, as wished.
Figure 2:
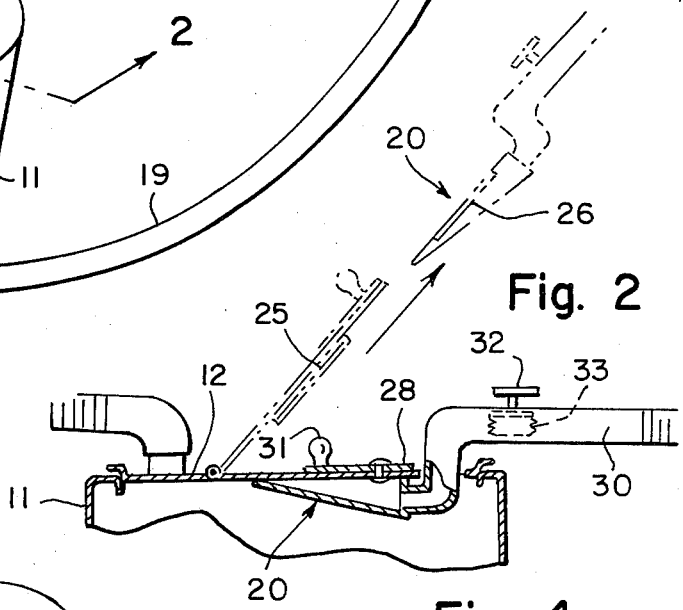
FIG. 2 is a cross sectional view on line 2—2 of FIG. 1.

Referring now to the drawing in greater detail, and more particularly to FIGS. 1 and 2 thereof, at this time, the reference numeral 10 represents a dust collector according to the present invention, wherein there is a bucket 11 having a removable fitted cover 12 in a top opening 13 thereof. The cover includes an upwardly pivotable lid 14 about a hinge 15 for closing a hole 16 in the cover through which ash or other refuse may be deposited for disposal. The lid also includes an upwardly extending spout 17 to which a suction hose 18 of a vacuum cleaner may be attached.

In the present form of the invention, a flexible hose 19 is also connected to a side of the bucket, and an ash scoop 20 is attached on the end of the hose 19 so that ash scooped up by the scoop is transmitted directly through the hose and int the bucket, so that it is not blown into the air.

The scoop accordingly includes a shielded rear area by means of a rear wall 21, sloping side walls 22, and a top wall 23 broken only by an entry 24 to the hose, while a broad flat bottom wall is exposed at its forward area for scooping purpose.

The lid 14 includes rails 25 on its underside so to receive flanges 26 on opposite sides of the scoop, in order that the scoop may be stored on an underside of the lid, as shown in FIG. 2. The lid includes a notch 27 normally closable by a rotatable tab 28 pivoted on a rivet 29, the notch providing a clearance for a tubular handle 30 of the scoop connected to the hose 19. A knob 31 is on the tab for convenient turning thereof.

In use, when ash is being scooped up, the vacuum cleaner is turned on and the lid is in a closed position while the notch is also closed. Thus a vacuum from the machine pulls the ash from upon the scoop, through the hose 19 and deposits it in the bucket.

Any flying dust inside the bucket is carried into the vacuum cleaner bag or canister so that it does not get into the atmosphere. During this operation a button 32 on the handle 30 is lifted so a bellows shaped, rubber valve 33 clears the passage through the handle for the ash.

When the ash is preferred to be thrown from the scoop into the hole 16 of the lid, instead of being pulled through the hose 19, then the valve 33 is closed so that air suction is through the hole 16 instead, thus drawing the ash off the front end of the scoop into the bucket.

Figure 3:
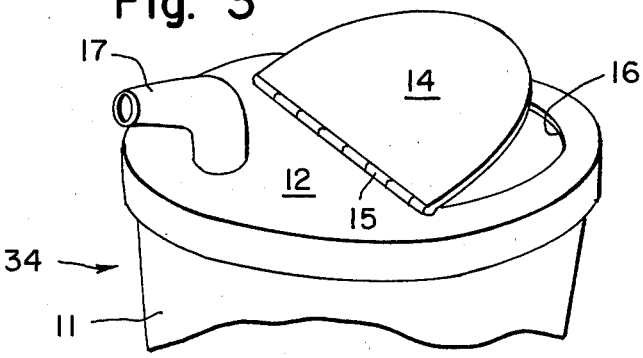
FIG. 3 is a perspective view of another design of the bucket.

FIG. 3 shows a modified design of dust collector 34 that is the same as dust collector 10 except that it does not include the scoop structure, so that all ash is dropped into the bucket through the lid hole 16 instead.

Figure 4:
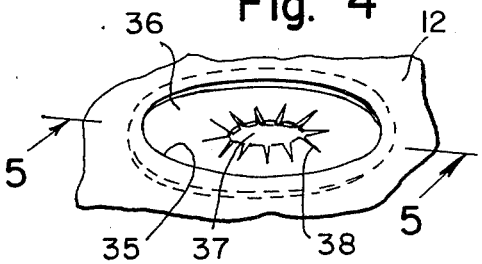
FIG. 4 is a perspective view of another design of orifice.
Figure 5:
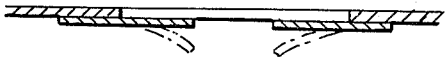
FIG. 5 is a cross sectional view on line 5—5 of FIG. 4.

FIGS. 4 and 5 show a design of orifice 35 in the cover 12 through which the vacuum cleaner hose 18 is insertable for connection to the dust collector not provided with a spout 17. The orifice is fitted with a flexible rubber diaphragm 36 having a central opening 37 that is slitted along its edge as shown at 38 for easy fit of the hose 18 therein.

Figure 6:
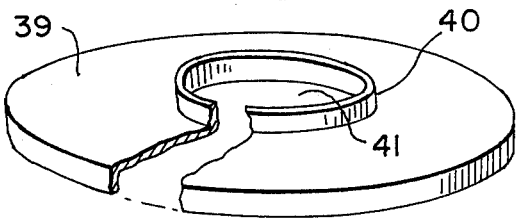
FIG. 6 is a perspective view of a circular adapter for a large cylindrical drum.

FIG. 6 shows an adapter 39 of circular shape for fitting upon a conventional garbage or refuse can, the adapter including upward flange 40 around an opening 41 so that the cover 12 can fit thereupon.

Figure 7:
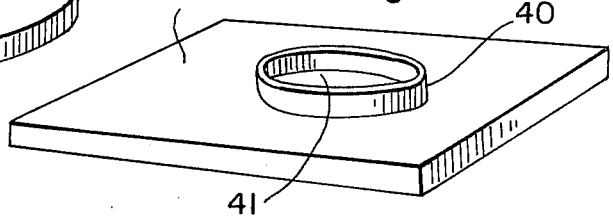
FIG. 7 is a similar view of a square adapter for a square shaped container.

FIG. 7 shows an adapter 42 that is the same as adapter 39 except that it is square for fitting upon a square shaped receptacle.

While various changes may be made in the detail construction, it is understood that such changes will be within the spirit and scope of the present invention as defined by the appended claims.

What is claimed:

1. A dust collector, comprising in combination, a bucket, a cover fitted in a top opening of said bucket, an upwardly pivotable lid on said cover for closing a semicircular hole in said cover, an upwardly extending spout on said cover for connection with a vacuum cleaner hose, and a flexible hose on a side of said bucket connnected to a scoop, whereby the inside of said scoop is in suction communication with the interior of said bucket.

2. The combination as set forth in claim 1, wherein said lid includes means for storage of said scoop on an underside thereof.

* * * * *